United States Patent [19]

Sherman et al.

[11] Patent Number: 4,629,502

[45] Date of Patent: Dec. 16, 1986

[54] PRESSURIZED REACTION OF REFRACTORY ORES WITH HEAT RECOVERY

[75] Inventors: Michael I. Sherman; Carl L. Elmore, both of Glens Falls, N.Y.; Robert J. Brison, Golden, Colo.

[73] Assignee: Kamyr, Inc., Glens Falls, N.Y.

[21] Appl. No.: 664,733

[22] Filed: Oct. 25, 1984

[51] Int. Cl.[4] ..... C01G 7/00; C22B 11/04

[52] U.S. Cl. ..... 75/118 R; 75/0.5 A; 75/0.5 AA; 75/0.5 BA; 75/2; 75/115; 75/101 R; 75/105; 423/25; 423/27; 423/29; 423/30; 423/31; 423/41; 423/45; 423/47

[58] Field of Search ..... 423/27, 29, 30, 31, 423/25, 109, 150, 41, 45, 47; 75/0.5 A, 0.5 AA, 2, 0.5 BA, 3, 105, 101 R, 118 R, 119, 120

[56] References Cited

U.S. PATENT DOCUMENTS

| | | | |
|---|---|---|---|
| 3,879,272 | 4/1975 | Atwood et al. | 75/117 |
| 4,071,611 | 1/1978 | Chilson | 423/41 |
| 4,097,271 | 6/1978 | Milner et al. | 75/104 |
| 4,108,639 | 8/1978 | Lake et al. | 75/101 R |
| 4,256,705 | 3/1981 | Heinen et al. | 423/27 |
| 4,423,010 | 12/1983 | Maurel | 423/87 |
| 4,438,076 | 3/1984 | Pietsch et al. | 75/99 |
| 4,501,721 | 2/1985 | Sherman et al. | 423/29 |

FOREIGN PATENT DOCUMENTS

| | | |
|---|---|---|
| 3126234 | 3/1983 | Fed. Rep. of Germany . |
| 781184 | 4/1978 | South Africa . |

OTHER PUBLICATIONS

Habashi, "Pressure Hydrometallurgy: Key to Better and Nonpolluting Process", E/MJ, Feb. 1971, pp. 96–100.

Habashi, "Pressure Hydrometallurgy: Key to Better and Nonpolluting Process," E/MJ, May 1971, pp. 88–94.

Linke, W. F., "Solubilities of Inorganic and Metal-Organic Compounds (Seidel)", 4th Ed., 1958, vol. 1, p. 250, and vol. 2, pp. 1228–1230.

Tronev, Von V. G., and Bondin, M., "On the Dissolution of Precious Metals at High Pressure; 11, Dissolution of Gold in Cyanide Under Air Pressure," Comptes Rendus (Doklady) de l'Academie des Scienes del l'URSS (1937), vol. 16, No. 5, pp. 281–284.

Headley, N. and Tabachnick, H., "Chemistry of Cyanidation, Mineral Dressing Notes," American Cyanamid Company, Dec. 1968.

Finkelstein, N. P., "The Chemistry of the Extraction of Gold From Its Ores," Chap. 10 in Gold Metallurgy in South Africa, 1972, See p. 309.

Davidson, R., Brown, G. A., Schmidt, C. G. et al., "The Inventive Cyanidation of Gold-Plant Gravity Concentrates," J.S. Afr. Inst. Min. Metall., 1978, pp. 146–165.

Pietsch, H. B., Turke, W., Rathje, G. H., "Research on Pressure Leaching of Ores Containing Precious Metals," Erzmetall, Jun. 1983, pp. 261–165.

Muir, C. W. A., Hendriks, L. P., and Gussman, H. W., "The Treatment of Refractory Gold-Bearing Flotation Concentrates Using Pressure Leaching Techniques," Precious Metals: Mining Extraction, and Processing, 1984, pp. 309–322.

*Primary Examiner*—John Doll
*Assistant Examiner*—Robert L. Stoll
*Attorney, Agent, or Firm*—Nixon and Vanderhye

[57] ABSTRACT

Metal is removed from particlized metal bearing refractory ores in an efficient manner utilizing pressure metallurgy with heat recovery. The particlized ore is mixed with a heated liquid, and preferably a flocculant and fibers, to form a slurry. The ore in the slurry is oxidized at superatmospheric pressure, and elevated temperatures (e.g. around 300° F.). The oxidized ore is washed to remove acids, and like products of oxidation, and the washed ore is subsequently subjected to conventional leaching processes to effect an actual metal recovery. Heat recovery is practiced by utilizing spent wash water as part of the slurrying liquid, and using two or more liquid-interconnected vessels in effecting the oxidization.

11 Claims, 1 Drawing Figure

PRESSURIZED REACTION OF REFRACTORY ORES WITH HEAT RECOVERY

BACKGROUND AND SUMMARY OF THE INVENTION

In copending application Ser. No. 503,178 filed June 10, 1983, now U.S. Pat. No. 4,501,721 (the disclosure of which is hereby incorporated by reference herein), a method was provided for removing predetermined constituents from a particlized mineral material, such as removing precious metals from a metal bearing ore. The invention disclosed therein is extremely useful for removing metals from many types of ores, however it is not particularly applicable to recovery of materials from refractory ores.

Refractory ores are those in which metal cannot be easily leached since it is held by chemical bonds or locked inside mineral particles. Often, the metal is bound with sulphur. A typical refractory ore is gold ore in which the gold is disseminated in iron sulfide. Other refractory ores are those containing aluminum (i.e. bauxite), and some nickel, cobalt, zinc, uranium, copper ores (i.e. chalcopyrite), and the like. Pressure hydrometallurgy has been successfully employed for effecting metal recovery from refractory ores. However conventional pressure hydrometallurgical processes are energy intensive since a large amount of heat is wasted in grinding of the ore prior to actual leaching, and such processes often consume substantial amounts of chemicals, such as lime for the neutralization of sulphuric acid which is formed when the metal-sulphur bonds are broken in the refractory ore.

According to the present invention, a pressure hydrometallurgical processes is provided which has numerous advantages over prior art processes for ultimately effecting metal removing from refractory ores. According to the present invention on continuous process is practiced, with careful heat recovery steps being implemented, so that the energy requirements are very substantially reduced compared to conventional pressure agitation and like processes. Also, according to the present invention continuous washing is effected of the refractory ore after the metal-sulphur bonds have been broken, so that no lime—or like chemical—need be consumed to neutralize the sulphuric acid and the like produced during oxidation, and in order to even allow acid recovery.

According to one aspect of the method according to the present invention, a method of removing metal from a particlized metal bearing refractory ore (one in which the metal is bound chemically, usually with sulphur) is provided. The method comprises the following steps:

(a) Mixing the particlized refractory ore with a heated liquid to form a heated liquid slurry.

(b) Continuously passing the slurry in a flow path.

(c) Oxidizing constituents of the ore in the slurry while in said flow path, at super atmospheric pressure and temperature above 212° F.

(d) Washing the ore in the slurry with a wash liquid to remove products of oxidation therefrom.

(e) Recovering heat from the slurry, including as part of step (d); and (f) subsequently effecting leaching of the washed, oxidized, particlized refractory ore, to effect recovery of metal therefrom.

In the practice of the invention, as in the practice of the method disclosed in said copending application Ser. No. 503,178, it is highly desirable to add flocculant and/or fibers to the slurry during mixing. The flocculant and fibers hold the particlized ore in a stable network in the slurry. The flocculant may be a natural or synthetic polymer such as a synthetic polymer of anionic, cationic, or nonionic type. The fibers may be cellulosic, fiberglass, or ceramic fibers (or mixtures thereof), and preferably the fibers make up about 0.01–10% by weight of the slurry.

According to another aspect of the present invention, a method of removing metal from a particlized metal bearing ore is provided which comprises the following steps:

(a) mixing the particlized refractory ore with a heated liquid to form a heated liquid slurry.

(b) Continuously passing the slurry to a top portion of the first vessel, and flowing the slurry downwardly in the first vessel.

(c) Introducing heated liquid containing an oxidizing agent into the bottom of the first vessel to flow countercurrently to the slurry flowing downwardly in the first vessel.

(d) Removing treated slurry from the bottom of the first vessel and passing it to a top portion of the second vessel so that it flows generally downwardly in the second vessel.

(e) Removing liquid from adjacent the top of the first vessel, and circulating that liquid to the bottom of the second vessel to flow in the second vessel generally countercurrently to the slurry flowing downwardly in the second vessel.

(f) Removing liquid from the second vessel adjacent the top thereof.

(g) Removing treated slurry from the bottom of the second vessel and passing it to a top portion of the third vessel so that it flows generally downwardly in the third vessel.

(h) Introducing wash water into the bottom of the third vessel so that it flows generally countercurrently to the slurry flowing downwardly therein.

(i) Removing spent wash liquid from adjacent the top portion of the third vessel; and (j) removing washed slurry from the bottom of the third vessel and subsequently effecting leaching treatment thereof so as to remove metal from the metal bearing refractory ore.

In the practice of this particular method, it is desirable to add oxygen (or like oxidizing agent) to the liquid removed from the first vessel before introduction into the second vessel, and to add oxygen to and heat the liquid removed from the second vessel, and then introduce it as the countercurrent flowing liquid at the bottom of the first vessel. The temperature of the liquid introduced at the bottom of the first vessel is preferably generally about 330° F. Flocculant and fibers prferably are added to the slurry during mixing.

It is the primary object of the present invention to provide an effective, energy efficient, and economical method facilitating the recovery of metal from refractory ores. This and other objects of the invention will become clear from an inspection of the detailed description of the invention, and from the appended claims.

DETAILED DESCRIPTION OF THE DRAWING

Figure 1:
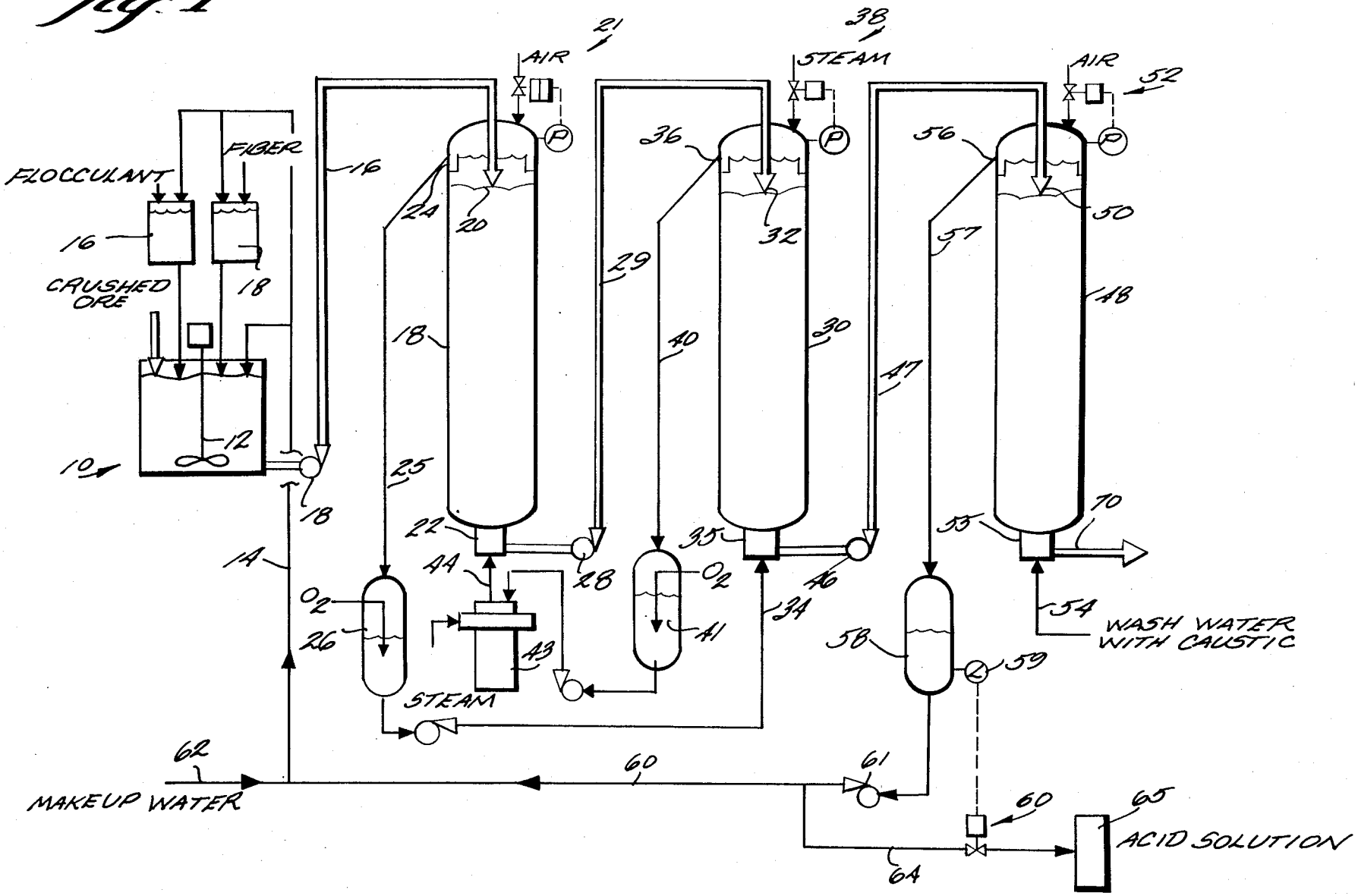
FIG. 1 is a schematic of exemplary apparatus for practicing an exemplary method according to the present invention.

The apparatus illustrated in FIG. 1 includes apparatus for mixing a heated liquid slurry, oxidizing the particlized metal bearing refractory ore in the slurry, continuously washing the ore to remove products of oxidation (primary sulphuric acid), and practicing heat recovery during the entire procedure.

In a tank 10 having a mixer 12 associated therewith, crushed (i.e. particlized) refractory ore (e.g. iron sulfide, bauxite, etc.) is mixed with heated liquid (e.g. 215° F.) from line 14, to form a slurry. Preferably a flocculant, such as a synthentic polymer anionic, cationic, or nonionic types of synthetic polymer, from flocculant tank 16, and fibers from tank 18 are also added to the tank 10. The fibers preferably comprise cellulosic, fiberglass, or ceramic fibers, or mixtures thereof, but fibers having potentially adverse environmental effects (such as asbestos) are preferably avoided. Fibers typically comprise 0.01–10% by weight of the slurry, and sufficient flocculant and fibers are provided to lock the particlized ore in a stable network in the slurry to thereby facilitate even, efficient, and successful continuous treatment.

From tank 10, the slurry is passed in a flow path through line 16 under the influence of pump 18 to a first vertical pressure vessel 18. Vessel 18 comprises an oxygen reactor. The slurry (e.g. at about 183° F.) is introduced into the vessel 18 at a top portion 20 thereof to flow generally downwardly in the vessel 18. Vessel 18 is maintained at super atmospheric pressure, including by pressure regulating means 21, and at a temperature above 212° F. The temperatures of the liquids and slurry at different points discussed herein are typical temperatures at which the various method steps according to the invention may be practiced, although the temperatures may vary widely depending on the particular ore, subsequent treatment stages, and like factors.

Oxidation of the ore, to effect breaking of the metal-sulphur bonds and the like, is effected in part by introducing a heated liquid containing oxidizing elements into the bottom of the vessel 18 at 22, to flow upwardly in the vessel countercurrent to the downwardly flowing slurry. Typically the oxidizing component of the liquid will be oxygen, although chlorine, chlorine dioxide, or other oxidizing agents may be used.

Spent treatment liquid (e.g. at about 256° F.) is removed from the vessel 18 adjacent the top thereof, at 24. A "stilling well" may be provided at the top of the vessel 18, or suitable screens may be provided thereat, to facilitate liquid removal. The liquid passes into conduit 25, and preferably additional oxidizing agent (such as oxygen gas) is added to the liquid at vessel 26.

The treated slurry from the bottom of the first vessel 18 is pumped by pump 28 in conduit 29 (e.g. at about 330° F.) to a top portion of a second vessel 30, being introduced at a top portion (32) of the vessel 30 so that the slurry flows generally downwardly in vessel 30. Countercurrently flowing liquid (e.g. at about 250° F.) is introduced through conduit 34 into the bottom 35 of the second vessel 30 to flow upwardly in vessel 30 countercurrent to the flow of slurry therein, and spent treatment liquid (e.g. at about 316° F.) is removed at point 36 adjacent the top of the second vessel 30, again utilizing screens, a "stilling well", or the like. The second vessel 30 is also maintained at superatmospheric pressure and elevated temperature, as by means 38.

In order to facilitate good heat recovery, and energy efficiency, the liquid withdrawn from the top of the second vessel 30 into line 40 is ultimately introduced as the counter-currently flowing liquid at the bottom 22 of the first vessel 18. An oxidizing agent (e.g. oxygen gas) is added to the liquid in tank 41, and the liquid is heated—as by indirect steam heating—in conventional heater 43, before passing into conduit 44 to be introduced into the bottom 22 of the vessel 18, at a temperature of about 330° F. Typically approximately 40 pounds of steam per ton of ore is used in the heater 43.

To further facilitate heat recovery, the liquid from line 25 and tank 26 is pumped into the line 34 to be used as the countercurrently flowing liquid in the second vessel 30.

From the bottom of the second vessel 30, the treated slurry (at about 259° F.) is pumped by pump 46 into line 47 and is subsequently introduced in to a top portion of the third vertical pressure vessel 48 (e.g. at 50). Vessel 48 is maintained at super atmospheric pressure and elevated temperature, including by pressure regulating means 52. Vessel 48 is a wash tower, and wash water (preferably with caustic, and at a temperature of about 90° F.) is introduced through line 54 into the bottom 55 of the vessel 48 to flow upwardly in the vessel 48 countercurrently to the generally downward flow of slurry that has been introduced through line 47. Spent wash liquid (e.g. at about 228° F.) is removed at 56, adjacent the top of the vessel 48, and again suitable screens or the like may be utilized to effect this liquid removal. The spend wash liquid passes in line 57 to tank 58, in which the level is controlled by level sensor 59 and solenoid operator valve 60.

The spent wash liquid in line 57 and tank 58 includes the products of the oxidation of the ore. Typically, this would primarily be sulphuric acid since the metal-sulphur bonds have been broken by the oxidation. A first part of the spent wash liquid is preferably circulated in line 60, under the influence of pump 61, to be combined with makeup water (e.g. at about 90° F.) from line 62 to supply the liquid in line 14 for mixing with the particlized ore in tank 10. This greatly facilitates heat recovery since the spent wash liquid typically would have a high temperature (e.g. about 228° F.). A second portion of the spent wash liquid passes in line 64 utilmately to a station 65 at which it is disposed of, or acid recovery is practiced.

The oxidized, washed, particlized ore slurry (at about 97° F.) that is removed through line 70 from the bottom of the wash tower 48 is subsequently passed to a leaching tower or otherwise subjected to leaching processes for the ultimate recovery of the metal therefrom. Any suitable conventional leaching process may be utilized, and there is no necessity for further grinding of the ore before passing it to the leaching processes. The particle size for the ore as introduced to the tank 10 is preferably the particle size that is most suited for the subsequent leaching processs. The utilization of flocculant and fibers allows a large variety of different sizes of particles to be effectively handled (as explained in said copending application Ser. No. 503,178, now U.S. Pat. No, 4,501,721), including fines of 200 mesh or smaller up to particle sizes up to about ½ inch in diameter.

It will be seen that in the practice of the present invention, no significant amount of chemicals—aside from oxidizing agents—are consumed since it is not necessary to neutralize the sulphuric acid produced as a reaction product of the oxidation. In fact, the sulphuric acid can be recovered, as a by-product of the process.

It will be further seen that according to the present invention because of the continuous nature of the process and the careful attention to heat recovery, relatively little energy is consumed. For instance, for an iron sulphide content of 40 pounds per ton of ore, there typically would be an exothermic action (as a result of oxidation) of about 4,626 BTUs/lb iron sulfide. The heat of this exothermic reaction is recovered in the practice of the method according to the invention. For instance, for a refractory ore having an iron sulphide content of 40 pounds per ton, utilizing conventional pressure agitation followed by one stage of CCD, 245,300 BTUs of steam are required per ton of ore. For conventional pressure agitation followed by two stages CCD, 91,800 BTUs of steam are required per ton of ore. By practicing the present invention, however, only about 40,400 BTUs of steam per ton of ore are required, a very substantial energy saving.

It will thus be seen that according to the present invention an effective, efficient, and economical method has been provided for facilitating the recovery of metals from metal bearing refractory ores. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and procedures.

What is claimed is:

1. A method of recovering gold from a particlized gold bearing refractory ore, comprising the steps of continuously:

(a) Mixing the particlized refractory gold ore with a liquid heated above ambient temperature to form a heated liquid slurry, and mixing the particlized ore with a flocculating material and fibers so as to lock the particlized ore in a stable network in the slurry;

(b) continously passing the slurry in a flow path;

(c) oxidizing oxidizable constituents of the ore in the slurry, to break metal-sulphur bonds, while in said flow path, at super-atmospheric pressure and temperature above 212° F.;

(d) washing the ore in the slurry with a wash water to remove products of oxidation, including sulphuric acid, therefrom;

(e) recovering heat from the slurry, including by removing spent wash water from the slurry and utilizing the spent wash water as heated liquid in step (a); and (f) subsequently effecting cyanide leaching of the washed, oxidized, particlized refractory gold ore, to effect recovery of gold therefrom.

2. A method as recited in claim 1 wherein the flocculant is selected from the group consisting essentially of synthetic polymers of anionic, cationic and nonionic types.

3. A method as recited in claim 2 wherein the fibers are selected from the group consisting essentially of cellulosic fibers, fiberglass fibers, ceramic fibers and mixtures thereof.

4. A method as recited in claim 3 wherein the fibers comprise about 0.01%–10% by weight, of the slurry.

5. A method as recited in claim 1 wherein the fibers comprise about 0.01%–10% by weight, of the slurry.

6. A method as recited in claim 5 wherein the fibers are selected from the group consisting essentially of cellulosic fibers, fiberglass fibers, ceramic fibers and mixtures thereof.

7. A method as recited in claim 1 wherein steps (b) and (c) are practiced by passing the heated liquid slurry generally downwardly in a flow path and flowing heating liquid at superatmospheric pressure countercurrently to the flow path of the slurry.

8. A method as recited in claim 7 wherein step (d) is practiced by flowing the oxidized particlized ore slurry generally downwardly countercurrent to a flow of wash water.

9. A method as recited in claim 8 utilizing first, second, and third generally vertical pressure vessels, each vessel having a slurry inlet at a top portion thereof, a slurry outlet at a bottom portion thereof, a countercurrent flowing liquid inlet at the bottom thereof and a spent liquid removal conduit at the top portion thereof; and wherein step (e) is further practiced by passing liquid removed from the top of the second vessel to be introduced as countercurrent flowing liquid at the bottom of the first vessel, and heating the liquid and adding oxygen thereto before introducing it at the bottom of the first vessel; and passing liquid removed from the top of the first vessel to be introduced as countercurrent flowing liquid at the bottom of the second vessel; and wherein the slurry from step (a) is introduced at the top of the first vessel, the slurry removed from the bottom of the first vessel is introduced at the top of the second vessel, the slurry removed from the bottom of the second vessel is passed to the top of the third vessel, and the slurry from the bottom of the third vessel is passed to step (f).

10. A method as recited in claim 1 wherein only a part of the spent wash water removed is passed, along with makeup water, to provide the heated liquid in step (a), and the rest of the spent wash water removed is passed to an acid recovery or disposal station.

11. A method as recited in claim 1 wherein the particlized refractory ore in step (a) has the particle size desired for the practice of step (f) so that no grinding of the ore is necessary prior to the practice of step (f).

* * * * *